US007249746B2

(12) United States Patent
Awalt

(10) Patent No.: US 7,249,746 B2
(45) Date of Patent: Jul. 31, 2007

(54) CLOSED-CELL FOAM END CAP RISER

(75) Inventor: Terry Awalt, Brewer, ME (US)

(73) Assignee: JSI Store Fixtures, Inc., Milo, ME (US)

( * ) Notice: Subject to any disclaimer, the term of this patent is extended or adjusted under 35 U.S.C. 154(b) by 0 days.

(21) Appl. No.: 11/257,350

(22) Filed: Oct. 24, 2005

(65) Prior Publication Data

US 2007/0090236 A1 Apr. 26, 2007

(51) Int. Cl.
*A47B 91/00* (2006.01)
*A47G 29/00* (2006.01)
*B65D 19/00* (2006.01)

(52) U.S. Cl. ..... 248/346.01; 248/346.3; 248/159; 248/188.2; 211/85.4; 108/92; 108/93

(58) Field of Classification Search ..... 248/615, 248/621, 159, 188.2, 346.01, 346.3; 446/115, 446/116, 85, 487, 488; 434/393, 403; 211/85.4; 108/92, 93
See application file for complete search history.

(56) References Cited

U.S. PATENT DOCUMENTS 168,715 A * 10/1875 Buck ..... 108/92
1,012,959 A * 12/1911 Zaharis ..... 108/92
1,124,631 A * 1/1915 Litchfield ..... 446/85
4,334,870 A * 6/1982 Roane ..... 434/211
5,176,596 A * 1/1993 Ullman ..... 482/52
5,354,247 A * 10/1994 Wilkinson ..... 482/52
5,396,847 A * 3/1995 Scott ..... 108/101
5,638,913 A * 6/1997 Blum ..... 182/33
5,647,786 A * 7/1997 Caspescha ..... 446/85
5,664,387 A * 9/1997 Bhatti ..... 52/604
5,685,441 A * 11/1997 Calfee ..... 211/194
5,785,530 A * 7/1998 Smith ..... 434/219
5,820,968 A * 10/1998 Kurani ..... 428/137
5,848,927 A * 12/1998 Frederiksen ..... 446/128
6,012,185 A * 1/2000 Woods et al. ..... 5/509.1
6,467,841 B1 * 10/2002 Henschel et al. ..... 297/284.5
6,518,499 B1 * 2/2003 Kessler ..... 174/50

* cited by examiner

*Primary Examiner*—Carl D. Friedman
*Assistant Examiner*—Michael McDuffie
(74) *Attorney, Agent, or Firm*—Anthony D. Pellegrini, Esq.

(57) ABSTRACT

A multi-piece display device for the point-of-sale display of produce and other damageable items, manufactured out of a closed cell foam material and of solid construction, with each piece being a monolithic, flexible support block, whereby each of said support blocks has a top surface and is of a different size than each other support block, and with each said support block other than the smallest support block suitably adapted to support upon its top surface a smaller said support block, thereby allowing the device to be arranged into any number of configurations for the display of produce or other items. The foam construction of the device protects the items from damage while being light weight and easy to clean.

20 Claims, 6 Drawing Sheets

CLOSED-CELL FOAM END CAP RISER

TECHNICAL FIELD

The invention relates generally to retail display devices for the point-of-sale display of produce and other damageable items and, more particularly, to a produce display stand known as an end cap riser that is used to display damageable produce.

BACKGROUND OF THE INVENTION

Retail display stands, and in particular produce end cap risers, are well known in the industry. Conventional display stands are typically constructed of multiple components involving labor-intensive manufacturing processes. They are of a rigid construction and configured in a fixed manner, whereby the interrelation of the various components is fixed with regard to each other, resulting in a single "look" for the stand. In addition, because of the multiple components, seams, joints, gaps, and other structures are of necessity utilized, providing access points to water, mold, and bacteria, which can damage the produce or other items displayed thereon. The rigidity of these display stands requires the use of additional padding in order to reduce the likelihood of damage to the items to be displayed.

The prior art fails to offer all of the functionality disclosed in the present invention, and thus none of the prior art anticipates the present invention.

It is an objective of the present invention to provide a useful, improved end cap riser suitable for supporting produce and other damageable items in an aesthetically pleasing manner while at the same time protecting the items so displayed.

It is a further objective of the present invention to provide a useful, improved end cap riser that is easily configurable in an unlimited number of arrangements.

It is a further objective of the present invention to provide a useful, improved end cap riser that is easy to manufacture.

It is a further objective of the present invention to provide a useful, improved end cap riser which is light weight, easy to clean, is impervious to water or other liquid penetration, and will not absorb odors.

It is a further objective of the present invention to provide a useful, improved end cap riser which is not easily damaged and which can satisfy its other objectives even if it becomes slightly damaged.

Other objectives of the present invention will be readily apparent from the description that follows.

SUMMARY OF THE INVENTION

The present invention is directed to a device for displaying produce and other damageable items, comprising multiple monolithic, flexible support blocks each constructed entirely of a closed cell foam material, such as closed cell pvc foam, with each support block having a top surface suitably adapted for supporting other support blocks and the items to be displayed.

The present invention may include one or more of the following features: each support block has a substantially planar top surface, a substantially planar base surface, and at least three side surfaces, with each side surface being substantially planar and adjacent to the top and base surfaces; each support block is of a different size than each other support block; each support block has a like number of side surfaces as each other support block; each support block has substantially the same shape as each other support block; each support block has a base surface with a greater width and depth than the width and depth of its top surface; and each support block has one or more side surfaces angled outward from its top surface to its base surface, at substantially the same angle for each side surface.

Other features and advantages of the invention are described below.

DETAILED DESCRIPTION OF THE INVENTION

Figure 1:
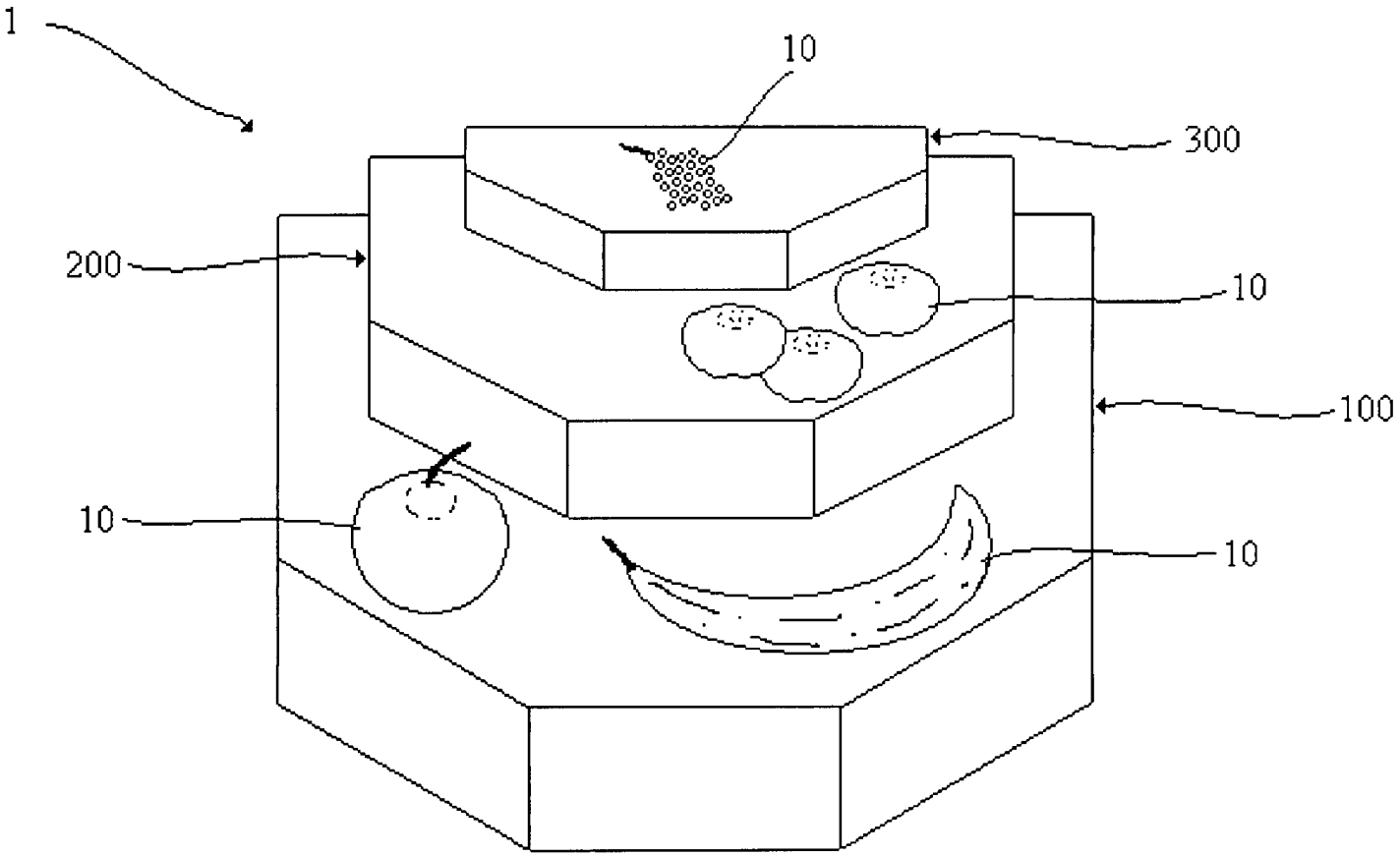
FIG. 1 is a perspective view of the preferred embodiment of the present invention.

The present invention is directed to an improved end cap riser device 1. The device 1 may be placed on any supporting surface, such as a table top or a floor. When used as intended, the device 1 supports items 10 placed upon it. See FIG. 1.

The device 1 is manufactured using closed cell foam material, such as closed cell pvc foam. The foam construction cushions the produce or other items to be displayed thereon and reduces bruising or other damage. Due to its foam construction, the device 1 is light weight, flexible, and fully immersible in water for easy cleaning.

Figure 3:
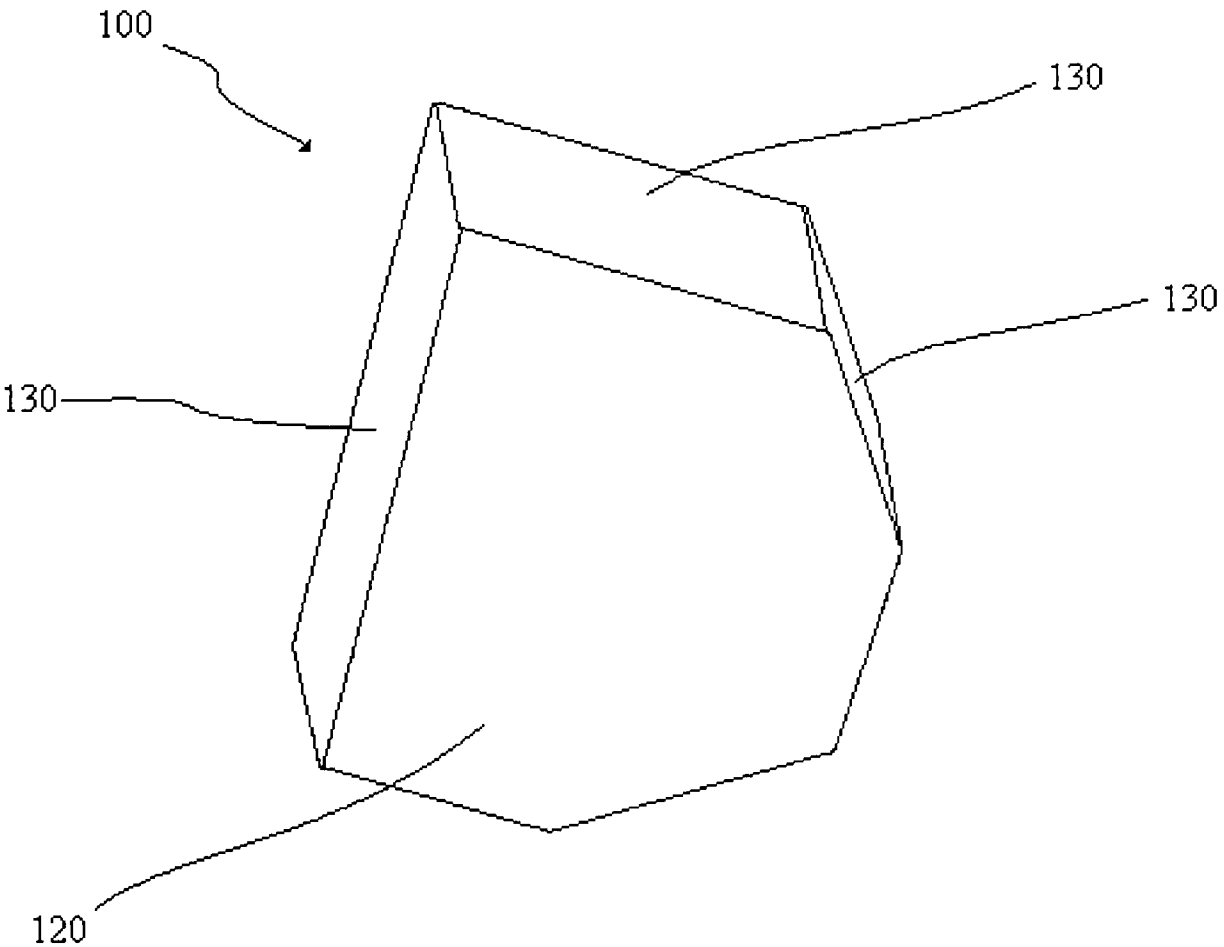
FIG. 3 is a perspective view of the underside of a support block of the present invention.
Figure 4:
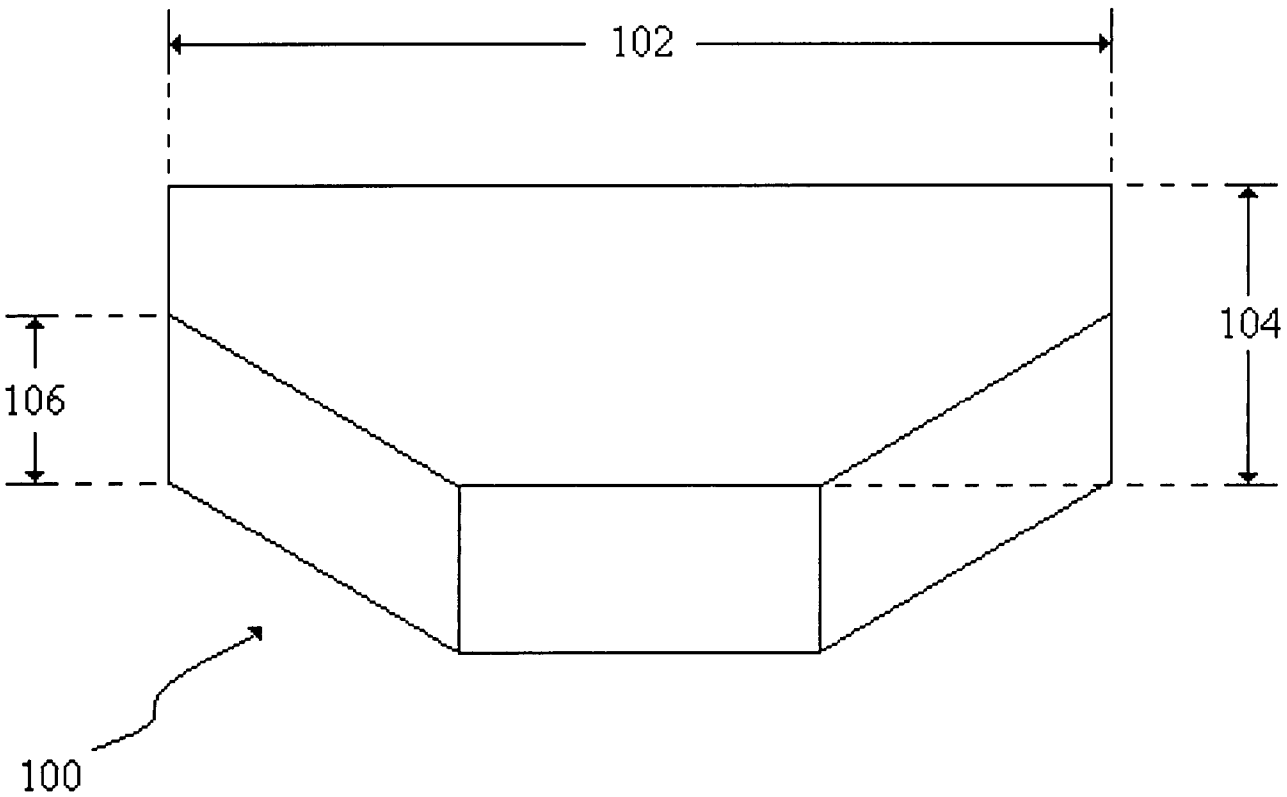
FIG. 4 is a perspective view of a support block of the present invention showing the width, depth, and height dimensions of said support block.

The device 1 comprises at least two monolithic, flexible, substantially solid support blocks 100, each constructed entirely of a closed cell foam material, as described above. Each support block 100 has a top surface 110, a base surface 120, and at least three side surfaces 130. See FIGS. 2 and 3. The top surface 110 of each support block 100 is substantially planar and oriented substantially horizontally. The base surface 120 of each support block 100 is substantially planar and oriented substantially parallel to the corresponding top surface 110. Each side surface 130 of each support block 100 is substantially planar, oriented substantially vertically, and adjacent to the corresponding top and bottom surfaces 110,120. Each side surface 130 of each support block 100 may be of the same shape and size as each other side surface 130, or may be of different shapes and sizes. The number, shapes, and sizes of the side surfaces 130 of each support block 100 are dictated by the configurations of the corresponding top surface 110 and bottom surface 120. The width 102 and depth 104 of each support block 100 are both greater than the height 106 of said support block 100. See FIG. 4. This provides the support block 100 stability when it is placed, base surface 120 oriented downward, on a supporting surface.

While each support block 100 is configured as described above, each support block 100 is of a different size than each other support block. See FIG. 2. Moreover, each support block 100 other than the smallest support block has a surface area of its top surface 100 larger than the surface area of the base surface of the next smaller support block. Each support block 100 other than the smallest support block is suitably adapted to support upon its top surface 110 a smaller support block. The support blocks may be stacked upon each other in any desired configuration, the placing of any support block upon another support block not limited to any specific orientation or position relative to the underlying support block.

Figure 2:
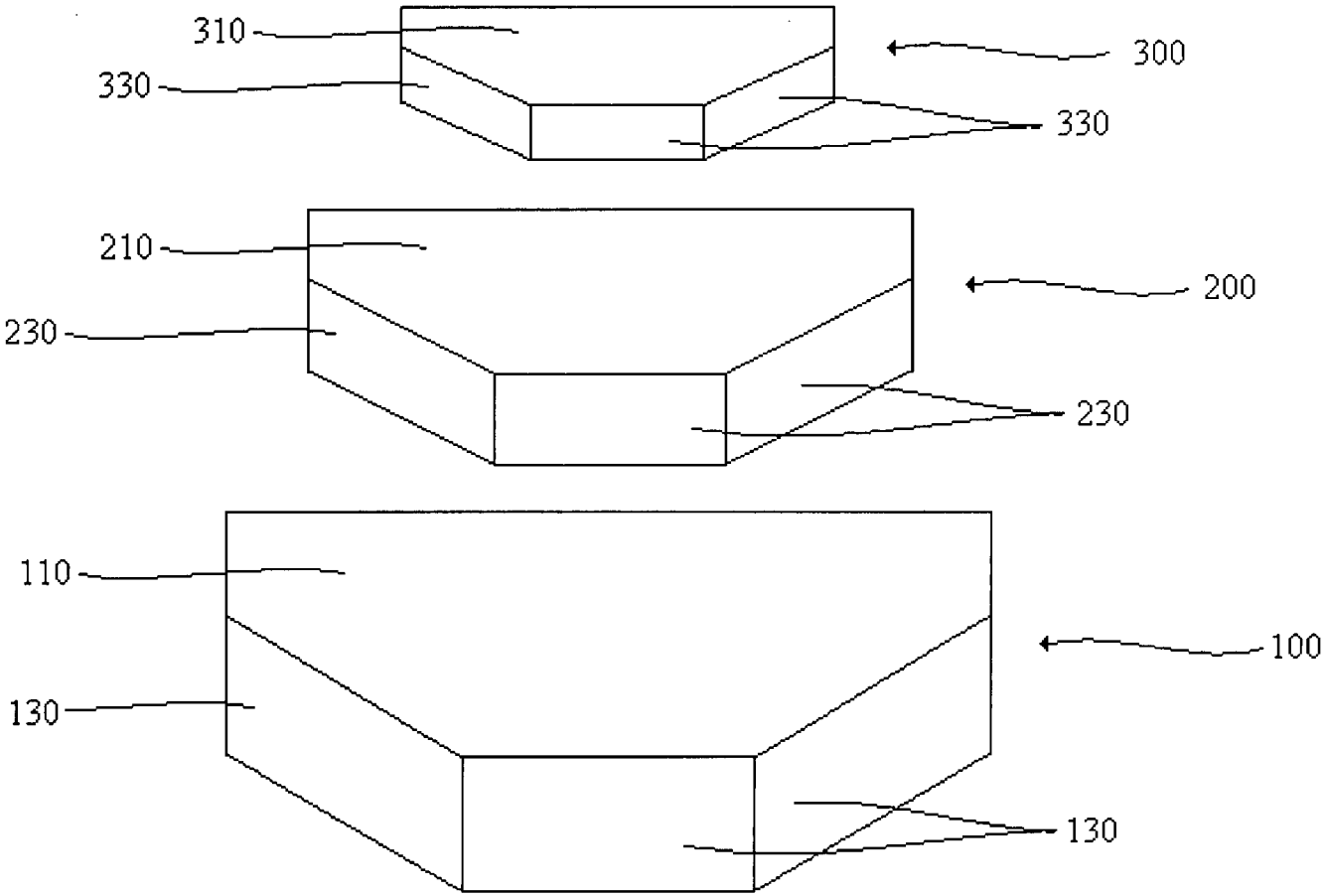
FIG. 2 is a perspective view of the individual elements of the preferred embodiment of the present invention.

In one embodiment of the present invention, each support block comprises a like number of side surfaces as each other support block. In the preferred embodiment the number of side surfaces of each support block is six. Moreover, in the preferred embodiment each support block has substantially the same shape as each other support block. This is shown in FIG. 2.

Figure 5:
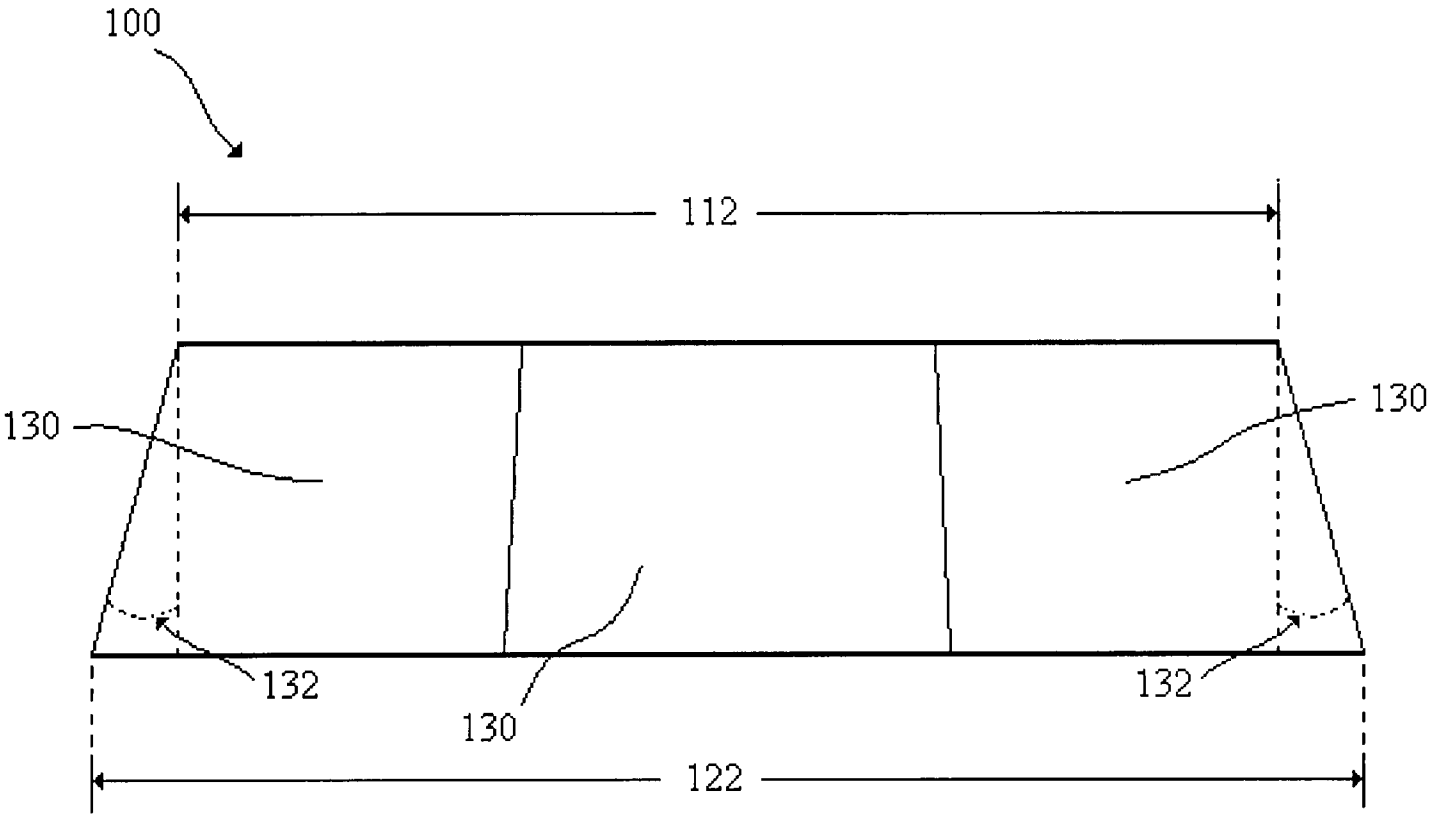
FIG. 5 is a front view of one embodiment of the present invention, showing a support block having a larger base surface than top surface.
Figure 6:
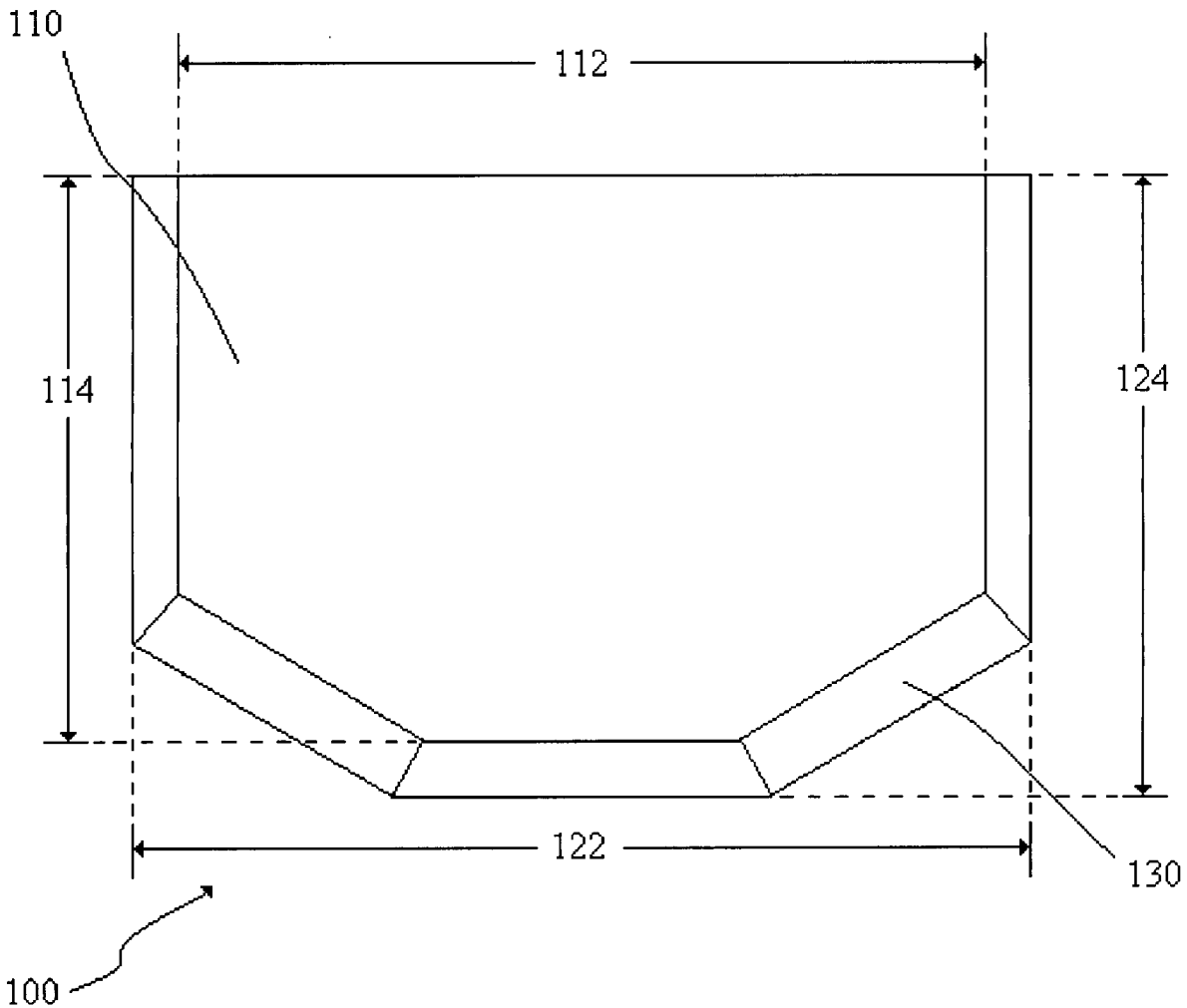
FIG. 6 is a top view of the same embodiment of the present invention depicting in FIG. 5.

In another embodiment, for each support block 100 the base surface 120 has a width 122 and a depth 124 greater than the width 112 and depth 114 of the top surface 110. See FIG. 6. As such, the top surface 110 has a smaller surface area than the bottom surface 120. In this embodiment, all side surfaces 130 of the support block 100 are not oriented perfectly vertical but rather one or more may lie in a plane at an angle 132 to the vertical to the top surface 110, such that each such angled side surface 130 may angle outward and downward from the top surface 110 of said support block 100 to the base surface 120 of that support block 100. See FIG. 5. Each such angle 132 is less than ninety degrees. In the preferred embodiment, each said angle 132 is substantially the same as every other angle for each angled side surface 130 of each support block. In one embodiment each support block 100 has six side surfaces configured substantially as shown in FIG. 6, with the side surface having the greatest width oriented substantially vertically and all other side surfaces oriented at an angle 132 to the top surface, all such angles 132 substantially identical, as described above. This configuration allows the device 1 to be placed flush against a wall.

In the preferred embodiment, the device 1 comprises a first support block 100, a second support block 200, and a third support block 300. See FIGS. 1 and 2. The first support block 100 is the largest, having a width 102, depth 104, and height 106 greater than the corresponding width, depth, and height of the second or third support blocks 200,300. The first support block 100 has a surface area of its top surface 110 greater than the surface area of the base surface of the second support block 200 and is suitably adapted to support on its top surface 110 either the second support block 200 or the third support block 300, with the first support block 100 directly supporting the second support block 200 in the preferred embodiment. The second support block 200 is larger than the third support block 300, having a width, depth, and height greater than the corresponding width, depth, and height of the third support block 300. The second support block 200 has a surface area of its top surface 210 greater than the surface area of the base surface of the third support block 300 and is suitably adapted to support on its top surface 210 the third support block 300. In the most preferred embodiment, the number of side surfaces 130 of the first support block 100 is the same as the number of side surfaces 230,330 of the second and third support blocks 200,300, and the shapes of the first, second, and third support blocks 100,200,300 are substantially the same. In this embodiment the surface area of the top surface 110 of the first support block 100 is at least twice the surface area of the base surface of the second support block 200, and the surface area of the top surface 210 of the second support block 200 is at least twice the surface area of the base surface of the third support block 300. Moreover, each of the first, second, and third support blocks 100,200,300 may have one or more angled sides, as described above, with the angle from the vertical of each such angled side substantially the same as each other angle to the vertical of each other angled side. This most preferred configuration maximizes the stability of the device 1 while also maximizing the portions of the top surfaces 110,210 of the first and second support blocks 100,200 available to support items 10 to be displayed, with the entire top surface 310 of the third support block 300 being available to support items 10 to be displayed.

The device 1 may be manufactured using compression molding technology. It is created out of closed cell foam material, such as closed cell pvc foam. A liquid mixture of closed cell foam material is created. The liquid mixture is placed into a mold through an aperture in the mold. The liquid mixture within the mold is heated under pressure until the liquid mixture expands and completely fills mold and solidifies. The resulting solid material is removed from the mold and cooled. During cooling, the solid material expands to its desired final size.

Among the advantages of the device 1 are the following. The device 1 holds produce and other items 10 safely while also providing a visually appealing display. The device 1 is configurable in an unlimited number of different arrangements to achieve different aesthetic looks. The variable sizes of the support blocks 100 provide added flexibility in the appearance of the display. The surfaces 110,120,130 of the support blocks 100 are substantially non-skid, so the support blocks 100 need not be arranged on a perfectly level surface, but the supporting surface, such as a table top, may be tilted somewhat for aesthetic purposes without risk of the support blocks 100 sliding off each other or the supporting surface. The device 1 is light weight and easy to clean. Each support block 100 is impervious to water or other liquid penetration and will not absorb odors, due to the closed cell foam construction. Each monolithic support block 100 of the device 1 simplifies the manufacturing process and increases manufacturing efficiency. The closed cell foam material construction of the device 1 provides a surface substantially impervious to mold, bacteria, or other organic compounds. The properties of closed cell foam also provide the benefit that, should a surface 110,120,130 of the device 1 sustain a cut or have a portion broken off, the inner portion of the cut or break will retain the same imperviousness as the previously unbroken surface. In addition, because the device 1 is made of a closed cell foam material, even if damaged it provides greater protection against bruising or damage than an end riser constructed of a rigid material. That is, if a surface 110,120,130 of the support block 100 is damaged, the underlying foam material has the same cushioning properties as the surfaces. Thus, produce or other items 10 placed on the device 1 are protected even if the device 1 is damaged.

The invention is not limited to what is described in the foregoing embodiments. For example, although a produce display stand is described in detail, the principles described herein may be used in the construction and manufacture of a stand for displaying any other type of perishable and/or damageable goods.

Other embodiments not specifically set forth herein are also within the scope of the following claims.

I claim:

1. A device for supporting and displaying items, comprising:

at least two monolithic, flexible support blocks, each said support block constructed entirely of a closed cell foam material, and each said support block having a top surface, wherein said top surface is substantially planar and has a width and a depth;

a base surface, wherein said base surface is substantially planar, substantially parallel to said top surface, and has a width and a depth, whereby the width of the base surface is greater than the width of the top surface and the depth of the base surface is greater than the depth of the top surface; and at least three side surfaces, wherein each said side surface is substantially planar, with each said side surface being adjacent to said top surface and to said base surface;

whereby each said support block is of a different size than each other said support block, with each said support block other than the smallest said support block suitably adapted to support upon its top surface a smaller said support block.

2. The device of claim 1 wherein for at least one support block at least one side surface angles outward and downward from the top surface of said support block to the base surface of said support block at an angle to a vertical to the top surface, said angle having less than ninety degrees.

3. The device of claim 2 wherein for each support block having at least two side surfaces which angle outward and downward from the top surface of said support block to the base surface of said support block at corresponding angles to a vertical to the top surface, for each said side surface said corresponding angle is substantially the same as each other angle corresponding to each other side surface of said support block which angles outward and downward from a vertical to the top surface of said support block to the base surface of said support block.

4. A device for supporting and displaying items, comprising:

at least two monolithic, flexible support blocks, each said support block constructed entirely of a closed cell foam material, and each said support block having a top surface, wherein said top surface is substantially planar;

a base surface, wherein said base surface is substantially planar and substantially parallel to said top surface; and six side surfaces, wherein each said side surface is substantially planar, with each said side surface being adjacent to said top surface and to said base surface;

whereby each said support block is of a different size than each other said support block, with each said support block other than the smallest said support block suitably adapted to support upon its top surface a smaller said support block, each support block comprises a like number of side surfaces as each other support block, and each support block has substantially the same shape as each other support block.

5. A device for supporting and displaying items, comprising:

at least two monolithic, flexible support blocks, each said support block constructed entirely of a closed cell foam material, and each said support block having a top surface, wherein said top surface is substantially planar and has a width and a depth;

a base surface, wherein said base surface is substantially planar, substantially parallel to said top surface, and has a width and a depth, whereby the width of the base surface is greater than the width of the top surface and the depth of the base surface is greater than the depth of the top surface; and at least three side surfaces, wherein each said side surface is substantially planar, with each said side surface being adjacent to said top surface and to said base surface;

whereby each said support block is of a different size than each other said support block, with each said support block other than the smallest said support block suitably adapted to support upon its top surface a smaller said support block, each support block comprises a like number of side surfaces as each other support block, and each support block has substantially the same shape as each other support block.

6. The device of claim 5 wherein for at least one support block at least one side surface angles outward and downward from the top surface of said support block to the base surface of said support block at an angle to a vertical to the top surface, said angle having less than ninety degrees.

7. The device of claim 6 wherein each support block comprises six said side surfaces.

8. The device of claim 6 wherein for each support block having at least two side surfaces which angle outward and downward from the top surface of said support block to the base surface of said support block at corresponding angles to a vertical to the top surface, for each said side surface said corresponding angle is substantially the same as each other angle corresponding to each other side surface of said support block which angles outward and downward from a vertical to the top surface of said support block to the base surface of said support block.

9. The device of claim 8 wherein each support block comprises six said side surfaces.

10. A device for supporting and displaying items, comprising:

a first monolithic, flexible support block, constructed entirely of a closed cell foam material, having a top surface, wherein said top surface is substantially planar, a base surface, wherein said base surface is substantially planar and substantially parallel to said top surface, and at least three side surfaces, wherein each said side surface is substantially planar, each said side surface being adjacent to said top surface and to said base surface;

a second monolithic, flexible support block, constructed entirely of a closed cell foam material, having a top surface, wherein said top surface of the second support block is substantially planar, a base surface, wherein said base surface of the second support block is substantially planar and substantially parallel to said top surface of the second support block, and a like number of side surfaces as found on the first support block, wherein each said side surface of the second support block is substantially planar, each said side surface of the second support block being adjacent to said top surface of the second support block and to said base surface of the second support block; and a third monolithic, flexible support block, constructed entirely of a closed cell foam material, having a top surface, wherein said top surface of the third support block is substantially planar, a base surface, wherein said base surface of the third support block is substantially planar and substantially parallel to said top surface of the third support block, and a like number of side surfaces as found on the first support block, wherein each said side surface of the third support block is substantially planar, each said side surface of the third support block being adjacent to said top surface of the third support block and to said base surface of the third support block;

whereby the first support block is larger in width and depth and height than the second support block, the second support block is larger in width and depth and height than the third support block, the first support block is suitably adapted to support upon its top surface the second support block, and the second support block is suitably adapted to support on its top surface the third support block.

11. The device of claim 10 wherein the second support block has substantially the same shape as the first support block; and the third support block has substantially the same shape as the second support block.

12. The device of claim 11 wherein the first support block comprises six said side surfaces.

13. The device of claim 12 wherein the top surface of the first support block has a calculated surface area, the base surface of the second support block has a calculated surface area, the top surface of the second support block has a calculated surface area, and the base surface of the third support block has a calculated surface area;

whereby the calculated surface area of the top surface of the first support block is at least twice the calculated surface area of the base surface of the second support block, and the calculated surface area of the top surface of the second support block is at least twice the calculated surface area of the base surface of the third support block.

14. The device of claim 11 wherein the base surface of the first support block has a width and a depth and the top surface of the first support block has a width and a depth, whereby the width of said base surface of the first support block is greater than the width of said top surface of the first support block and the depth of said base surface of the first support block is greater than the depth of said top surface of the first support block;

the base surface of the second support block has a width and a depth and the top surface of the second support block has a width and a depth, whereby the width of said base surface of the second support block is greater than the width of said top surface of the second support block and the depth of said base surface of the second support block is greater than the depth of said top surface of the second support block; and the base surface of the third support block has a width and a depth and the top surface of the third support block has a width and a depth, whereby the width of said base surface of the third support block is greater than the width of said top surface of the third support block and the depth of said base surface of the third support block is greater than the depth of said top surface of the third support block.

15. The device of claim 14 wherein at least one said side surface of the first support block is an angled side surface, said angled side surface angling outward and downward from a vertical to the top surface of the first support block to the base surface of the first support block at an angle to the top surface of the first support block, said angle having less than ninety degrees;

at least one said side surface of the second support block is an angled side surface, said angled side surface angling outward and downward from a vertical to the top surface of the second support block to the base surface of the second support block at an angle to the top surface of the second support block, said angle having less than ninety degrees; and at least one said side surface of the third support block is an angled side surface, said angled side surface angling outward and downward from a vertical to the top surface of the third support block to the base surface of the third support block at an angle to the top surface of the third support block, said angle having less than ninety degrees.

16. The device of claim 15 wherein the first support block comprises six said side surfaces.

17. The device of claim 16 wherein the top surface of the first support block has a calculated surface area, the base surface of the second support block has a calculated surface area, the top surface of the second support block has a calculated surface area, and the base surface of the third support block has a calculated surface area;

whereby the calculated surface area of the top surface of the first support block is at least twice the calculated surface area of the base surface of the second support block, and the calculated surface area of the top surface of the second support block is at least twice the calculated surface area of the base surface of the third support block.

18. The device of claim 15 wherein each angle of each angled side surface of the first support block is substantially the same as each other angle for each other angled side surface of the first support block;

each angle of each angled side surface of the second support block is substantially the same as each other angle for each other angled side surface of the second support block; and each angle of each angled side surface of the third support block is substantially the same as each other angle for each other angled side surface of the third support block.

19. The device of claim 18 wherein the first support block comprises six said side surfaces.

20. The device of claim 19 wherein the top surface of the first support block has a calculated surface area, the base surface of the second support block has a calculated surface area, the top surface of the second support block has a calculated surface area, and the base surface of the third support block has a calculated surface area;

whereby the calculated surface area of the top surface of the first support block is at least twice the calculated surface area of the base surface of the second support block, and the calculated surface area of the top surface of the second support block is at least twice the calculated surface area of the base surface of the third support block.

* * * * *